US006730376B2

(12) United States Patent
Stofko et al.

(10) Patent No.: US 6,730,376 B2
(45) Date of Patent: May 4, 2004

(54) THERMALLY TRANSFERABLE COMPOSITIONS AND METHODS

(75) Inventors: John J. Stofko, St. Paul, MN (US); Mark Hendrickson, Minneapolis, MN (US); Michael G. O'Reilly, Vadnais Heights, MN (US); Hsin Hsin Chou, Woodbury, MN (US); Richard Severance, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 101 days.

(21) Appl. No.: 09/780,225

(22) Filed: Feb. 9, 2001

(65) Prior Publication Data

US 2002/0155266 A1 Oct. 24, 2002

(51) Int. Cl.[7] ..... B41M 5/26
(52) U.S. Cl. ..... 156/235; 106/31.01
(58) Field of Search ..... 428/195, 913, 428/914, 32.6; 106/31.01

(56) References Cited

U.S. PATENT DOCUMENTS

| | | | | |
|---|---|---|---|---|
| 4,153,412 | A | 5/1979 | Bailey | 8/2.5 A |
| 4,818,591 | A | 4/1989 | Kitamura et al. | 428/216 |
| 4,904,737 | A | 2/1990 | Sato et al. | 525/286 |
| 5,005,028 | A | 4/1991 | Tamura et al. | |
| 5,320,898 | A | 6/1994 | Yoshida et al. | 428/195 |
| 5,393,590 | A | 2/1995 | Caspari | 428/195 |
| 5,460,918 | A | 10/1995 | Ali et al. | 430/200 |
| 5,508,105 | A | 4/1996 | Orensteen et al. | 428/323 |
| 5,706,133 | A | 1/1998 | Orensteen et al. | 359/530 |
| 5,976,698 | A | 11/1999 | Staral et al. | |
| 5,977,263 | A | 11/1999 | Phillips | 525/329.9 |
| 6,025,017 | A | 2/2000 | Roth | 427/146 |

FOREIGN PATENT DOCUMENTS

| | | |
|---|---|---|
| DE | 36 34 049 | 9/1987 |
| DE | 43 13 519 | 10/1994 |
| EP | 0 808 249 | 7/1999 |
| GB | 2 193 687 | 2/1988 |
| WO | WO 95/13195 | 5/1995 |
| WO | WO 96/24493 | 8/1996 |
| WO | WO 97/05200 | 2/1997 |
| WO | WO 97/20696 | 6/1997 |
| WO | WO 00/50248 | 8/2000 |

*Primary Examiner*—B. Hamilton Hess
(74) *Attorney, Agent, or Firm*—Carolyn A. Fischer

(57) ABSTRACT

A photocurable thermally transferable composition containing a multifunctional monomer that is substantially non-liquid at room temperature and a thermoplastic binder is disclosed. The composition is suitable for use in thermal transfer ribbons. After thermal transfer, the compositions are photocured to provide a durable, weatherable image on a graphic article.

16 Claims, 1 Drawing Sheet

THERMALLY TRANSFERABLE COMPOSITIONS AND METHODS

FIELD OF THE INVENTION

The present invention is directed to thermally transferable compositions for use in imaging applications. The invention also relates to thermal transfer articles, to graphic articles comprising a graphic image formed using the thermally transferable compositions, and to methods of making and using such thermally transferable compositions.

BACKGROUND

Graphic articles, such as advertisements, traffic signs, banners, license plates, retail signs, on-vehicle graphics, etc. are widely used. Depending upon the application such articles are often subjected to demanding environmental conditions, including exposure to extreme temperature fluctuations, exposure to precipitation, sunlight, and physical wear from contact with people or objects, chemical attack by cleaning fluids or solvents, and other chemical agents in the environment. Graphic articles used in exterior applications face particularly harsh weathering conditions, and must be produced such that they are able to withstand such conditions.

Graphic articles can be formed by various methods. These methods include, for example, screen-printing methods, lithographic printing methods, and adhesive sheet transfer methods. One specific method of forming graphic articles is thermal transfer, which transfers a color layer from a first substrate or carrier film, usually a plastic film, to a second substrate or target surface. Thermal transfer methods form the graphic image by selectively transferring only portions of the color layer from the first substrate onto the second substrate. One advantage of thermal transfer methods is that they allow the color layer to be made as a uniform sheet without a latent image, and the graphic pattern is defined by controlling the application process. This allows a limited number of carrier films to be used to produce a great variety of customized graphic articles.

During the thermal transfer process it is desirable to have the thermally transferable composition readily transfer from the carrier to the target surface. This can be facilitated, for example, by using a thermally transferable composition that softens at low temperatures so that it readily transfers upon application of heat. Unfortunately, thermally transferable compositions that melt or soften at low temperatures can also be less durable when exposed to high temperatures during use. It is also desirable that the thermally transferable composition transfers cleanly to produce sharp edges along its perimeter. This allows creation of more precise transfers with greater sharpness and detail. It is desirable that the thermally transferred composition has good durability, and be able to withstand temperature fluctuations and other related environmental exposure. In particular, it is desirable that the cured composition has good durability without the need to perform excessive additional production steps or use additional materials, such as over-laminating with a protective layer.

Although graphic articles having images formed by thermal transfer normally provide satisfactory print quality, legibility, and adhesion, a need remains for improved thermally transferable compositions and articles.

SUMMARY OF THE INVENTION

The present invention is directed to thermally transferable compositions and articles, and methods of using the compositions and articles. The compositions permit easy, precise transfer of color layers to various substrates; and are photocurable to produce a strong, durable, weatherable image.

The photocurable, thermally transferable compositions of the invention include a multifunctional monomer that is substantially non-liquid at room temperature, plus a thermoplastic binder. The multifunctional monomer normally contains from 15 to 60 carbon atoms, and can include a dicyclohexane compound of the general formula:

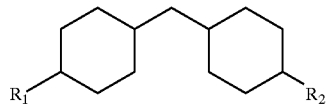

wherein $R_1$ and $R_2$ comprise functional groups containing a total of at least two acrylate groups. Suitable multifunctional monomers include dicyclohexane compounds of the general formula:

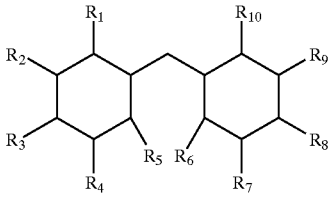

wherein at least two, and typically two to four, of $R_1$ to $R_{10}$ comprise functional groups containing acrylate groups.

The relative amounts of multifunctional monomer and binder depend upon the application, and specific applications use a composition that contains 50 percent or more by weight multifunctional monomer based upon total weight of multifunctional monomer and binder. In other implementations the composition contains from 60 to 80 percent by weight multifunctional monomer and from 20 to 40 percent by weight thermoplastic polymeric binder based upon total weight of multifunctional monomer and binder.

The invention includes thermal transfer articles containing a substrate, and a photocurable thermally transferable composition on the substrate. The photocurable thermally transferable composition contains a multifunctional monomer that is substantially non-liquid at room temperature and a binder. The substrate can be, for example, a ribbon or a sheet.

The invention is also directed to various printed articles containing a photocured coating formed from the cured composition of the invention. Specifically, the articles include one or more layers of a thermally transferable composition containing a multifunctional monomer that is substantially non-liquid at room temperature and a thermoplastic binder. The thermally transferable composition is applied to the article using heat to soften the composition. After transfer the composition is cured using actinic radiation to crosslink the monomer at its functional groups and provide a durable finished graphic article.

The invention also includes methods for forming a photocured thermally transferred image. The method includes providing a photocurable composition containing a multifunctional monomer that is substantially non-liquid at room temperature and a thermoplastic binder; heating the photocurable composition; transferring the photocurable composition to a substrate; and crosslinking the photocurable composition by exposure to actinic radiation.

Other features and advantages of the invention will be apparent from the following detailed description of the invention and the claims. The above summary of principles of the disclosure is not intended to describe each illustrated embodiment or every implementation of the present disclosure. The drawings and the detailed description that follow more particularly exemplify certain embodiments utilizing the principles disclosed herein.

DRAWINGS

The invention will be more fully explained with reference to the following drawings, in which similar reference numerals designate like or analogous components throughout, and in which.

Figure 1:
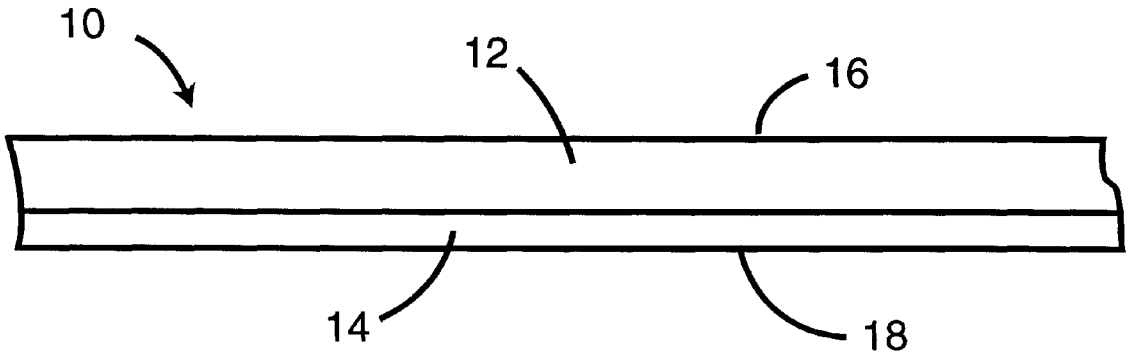
FIG. 1 is cross-sectional view of a first thermal transfer article in accordance with an implementation of the invention.

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION OF THE INVENTION

The present invention is directed to thermally transferable compositions and articles, and methods of using the compositions and thermal transfer articles to create graphic articles. As used herein the term "thermal transfer article" refers to an article having at least one thermally transferable layer thereon (such as a color layer), whereas the term "graphic article" refers to a signage article containing a transferred layer derived from the compositions described herein.

The compositions are thermally transferable to permit easy, precise transfer to substrates; and photocurable to produce a strong, durable, weatherable image. The composition is first thermally transferred to a substrate and then photocured at crosslinking functional groups on the multifunctional monomer. Crosslinking enhances the durability and weatherability of the cured composition.

Graphic articles of the invention exhibit good exterior durability, abrasion resistance, flexibility, and legible graphics. As used herein the terms durable and durability refer to characteristics such as solvent and chemical resistance, ultraviolet light resistance, abrasion resistance, bond maintenance of the thermally transferred layer to the print substrate, and maintenance of color brightness. The terms weatherable and weatherability refer to the characteristics such as maintenance of brightness, resistance to dirt, resistance to yellowing and the like, all of these in normal use conditions in the outdoors, where sunlight, temperature, and other environmental parameters may affect performance.

Figure 2:
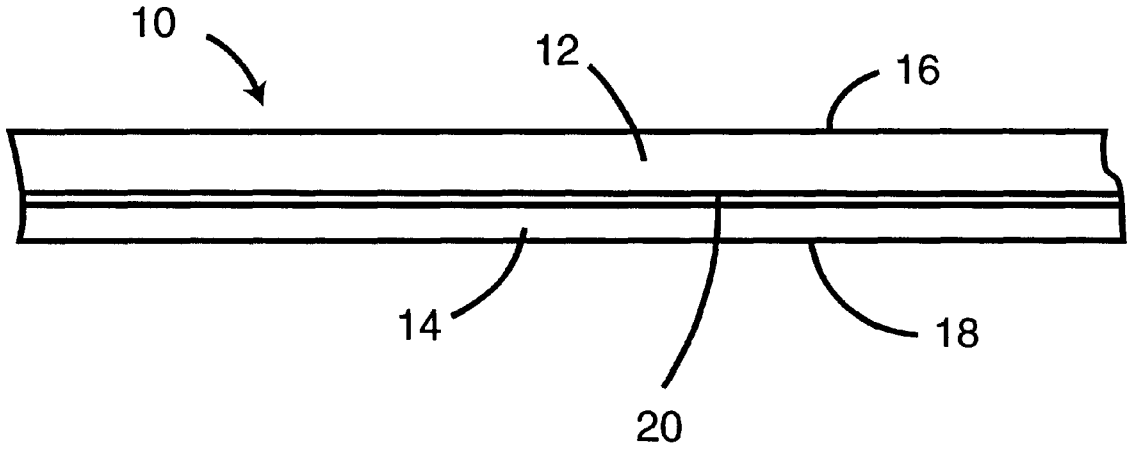
FIG. 2 is a cross-sectional view of a second thermal transfer article in accordance with an implementation of the invention.

The general configurations of example thermal transfer articles produced in accordance with the present invention are depicted schematically in FIG. 1 and FIG. 2. In FIG. 1, thermal transfer article 10 includes a colorant layer 12 placed directly onto a carrier film 14. Colorant layer 12 contains the thermally transferable composition of the invention. In use, heat is applied to the colorant layer 12 either directly (such as by exposing the surface 16 of colorant layer 12 to infrared radiation) or indirectly (such as by heating the surface 18 of carrier film 14 with infrared radiation or a warm print head). After the colorant layer 12 has been heated, it is brought into contact with the surface of a receiving substrate (not shown), the colorant layer 12 is removed, and the portion of colorant layer retained on the substrate is crosslinked with actinic radiation. FIG. 2 shows a similar example thermal transfer article, but also includes a release liner 20 having a low affinity to the colorant layer 12 in order to promote a clean transfer of the colorant layer to the substrate.

In addition to use of the composition of the invention to impart a colored graphic image, the composition can also be used as a thermally transferred and radiation cured clear-coat over a graphic image. In such implementations the composition does not contain a pigment or other colorant. In all other regards, the composition is the same as colorant layer 12, identified above. Thus, for such implementations, colorant layer 12 includes layers that are clear or substantially clear and layers that are not clear or substantially clear. When the layers are clear they can optionally be colorless.

The various ingredients of the compositions of the invention, as well as their use and application, will now be described in additional detail.

Multifunctional Monomer

The photocurable thermally transferable composition useful in accordance with the invention includes a multifunctional monomer having a high melting or softening temperature such that it is substantially non-liquid at room temperature. As used herein, multifunctional means to have two or more functional groups, and substantially non-liquid means to be either a solid or a semisolid that does not readily flow, such as a material having a high viscosity. The elevated melting or softening temperature of the monomer reduces tackiness of the finished thermal transfer article, thereby helping to avoid blocking. The multifunctional monomer normally contains from 10 to 200 carbon atoms, and more typically contains from 15 to 60 carbon atoms, and can include cycloaliphatic groups having a total of two or more acrylate functional groups. The acrylate functional groups are typically attached directly to the cycloaliphatic rings. Suitable cycloaliphatic groups include cyclohexanes, and specifically multifunctional monomers having dicyclohexane groups. Suitable dicyclohexane compounds include those of the general formula:

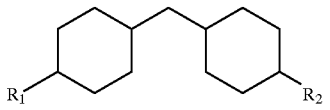

wherein $R_1$ and $R_2$ comprise functional groups containing a total of at least two acrylate groups. As used herein acrylate groups include both acrylate and methacrylate groups. $R_1$ and $R_2$ can each have acrylate groups, or the acrylate groups can be on one of $R_1$ or $R_2$. Thus, the multifunctional monomer can have two acrylate groups on $R_1$, two acrylate groups on $R_2$, or one or more acrylate groups on each of $R_1$ and $R_2$. $R_1$ and $R_2$ are typically positioned para to the location where the two hexane rings are joined. Preferably the multifunctional monomer has at least one acrylate group on each of $R_1$ and $R_2$. Normally the multifunctional monomer molecule is at least trifunctional.

The functional groups can be positioned at various carbon atoms on the multifunctional monomer. When dicyclohexane multifunctional monomers are used the functional groups are usually arranged such that at least one functional group is positioned on each cyclohexane ring, typically in a position para to the linkage between the cyclohexane rings. The multifunctional monomer can include a dicyclohexane compound of the general formula:

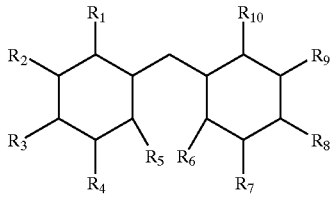

wherein at least two, and typically two to four of $R_1$ to $R_{10}$ comprise functional groups containing acrylate groups. In most implementations the number of functional groups is less than 10. Thus, the number of functional groups normally ranges from 2 to 10.

The multifunctional monomer can comprise a uniform multifunctional monomer having identical locations for the functional groups, but it is more common to have at least some variability in both the number and location of functional groups. By controlling the number and location of functional groups it is possible to influence the amount of crosslinking and the final properties of the cured thermal transfer composition in addition to the properties of the uncured layer before and after transfer.

The multifunctional monomer can contain additional substituents besides the acrylate functional groups described herein. Therefore $R_1$ and $R_2$ refer only to the possibility of functional groups, and do not exclude molecules with additional functionality. This is explicit by use of the term "general formula". The additional substituents preferably do not destroy crystallinity, and thus do not reduce the temperature at which the composition becomes non-liquid.

Thermoplastic Binder

The binder is typically polymeric, but is optionally formed of smaller oligomeric components, and can include mixtures of polymers and oligomers. The binder can include vinyl or acrylate resin, polyolefin resins, ethylene-vinyl co-polymers, ethylene-alkyl(meth)acrylate co-polymers, thermoplastic cellulosic resins, terpene resins, polyketone resins, polyvinylacetals, polycarbonates, polyurethane resins, polystyrene and polystyrene co-polymers, polyester resins, and mixtures thereof. Reactive thermoplastic resins, which include free-radical photopolymerizable moieties, can also be included. Preferred binders include vinylacetate/vinylchloride or carboxyl or hyrdoxy modified vinylacetate/vinylchloride copolymers such as those commercially available from Union Carbide under the trade designation "UCAR" resins. A particularly preferred binder is a terpolymer of vinyl alcohol, vinyl acetate, and vinyl chloride commercially available from Union Carbide under the trade designation "VAGH".

Thermally Transferable Composition

The thermally transferable compositions of the present invention include a combination of multifunctional monomer and thermoplastic binder, along with additional optional ingredients. The relative amounts of multifunctional monomer and binder depend upon the desired properties and intended applications for the thermally transferable composition. When greater crosslinking is desired, increased quantities of the multifunctional monomer relative to the binder are typically used. Alternatively, multifunctional monomers containing a greater number of functional groups can be used. When less crosslinking is desired, it is possible to reduce the amount of multifunctional monomer or to reduce the number of functional groups on the monomer. By controlling the amount of crosslinking, the wear resistance, dimensional stability (in response to changes in temperature and humidity), hot melt adhesive properties (e.g., melting temperature), tensile strength, adhesion, and heat resistance can be modified in some instances.

In specific applications the thermally transferable composition contains 50 percent or more by weight multifunctional monomer based upon total weight of multifunctional monomer and binder. In other implementations the composition contains from 60 to 80 percent by weight multifunctional monomer and from 20 to 40 percent by weight thermoplastic polymeric binder based upon total weight of multifunctional monomer and binder.

The thermally transferable compositions of the invention have a softening or melting temperature low enough to permit quick, complete transfer under high-speed production conditions, yet high enough to avoid softening or blocking during routine storage, such as storage as a roll good. The thermally transferable compositions can have a relatively low softening or melting temperature, yet are durable because they are crosslinked after application. In some embodiments the thermally transferable composition has a softening or melting temperature between about 50° C. and about 140° C., more preferably between about 60° C. and about 120° C., and most preferably between about 70° C. and about 100° C. The softening or melting temperature is normally maintained above 40° C., more typically above 50° C., and even more typically above 60° C.

The thickness of the thermally transferable layer will depend upon the desired thickness of the image on the finished graphic article, which impacts performance, durability, and weatherability. In addition, the thickness of the thermally transferable layer impacts application conditions. Normally, thicker transfer layers require longer exposure times to a heat source or higher heat source temperatures. Layers that are too thick can tend to undesirably increase the thermal conductivity of the thermally transferable article such that graphic resolution is impaired. Layers that are too thin may tend to yield graphics that do not exhibit desired durability, hiding power, etc. The thermally transferable layer is typically from about 1 to 10 microns thick, more typically from about 2 to about 8 microns, and most typically from about 3 to about 6 microns thick.

Additional Ingredients

The thermally transferable compositions of the invention can include various additional ingredients to improve appearance, thermal transfer performance, durability, or weatherability. For example, various colorants can be incorporated into the thermally transferable composition of the invention. Colorants useful within the scope of the invention include organic pigments, inorganic pigments, dyes, metallic (for example, aluminum) flakes, glass flakes, and pearlescent materials.

Pigment particles tend to act as fillers and reduce the cohesive strength of the thermally transferable layer as the pigment loading is increased. Increasing pigment loading will tend to decrease the cohesive strength of the layer, making imagewise transfer from a thermal mass transfer element of the invention easier, but also tending to reduce the durability of the transferred image. This effect varies somewhat depending upon the properties of the pigment(s) and other components of the layer. Incorporating too much pigment tends to yield a resultant image that may be friable and not sufficiently durable. Incorporating too little pigment will tend to yield a color layer that does not exhibit desired strength of color and which may not transfer well, yielding images of poor resolution and quality. Typically the pigment loading is optimized at low levels to achieve a desired balance of color and cohesive strength. In some instances, other materials will be incorporated into the composition to adjust the cohesive strength of the layer as desired.

Other optional additives that can be incorporated into the color layer include cosolvents, surfactants, defoamers, antioxidants, light stabilizers (e.g., hindered amine light stabilizers), ultraviolet light absorbers, biocides, etc. Surfactants can improve the dispersibility of the color agents in the binder prior to application of the color layer to a substrate, and can improve the coatability of the color layer.

Carrier Film

The thermally transferable composition of the invention is normally retained on a carrier film prior to thermal transfer. The carrier film can include a sheet, ribbon, or other structure. In thermal transfer articles that employ a carrier film, the carrier film is preferably from about 1 to about 10 microns thick, more preferably from about 2 to 6 microns thick. An optional anti-stick/release coating can be coated onto the side of the carrier film not having the thermally transferable composition. Anti-stick/release coatings improve handling characteristics of the articles. Suitable anti-stick/release materials include, but are not limited to, silicone materials including poly(lower alkyl)siloxanes such as polydimethylsiloxane and silicone-urea copolymers, and perfluorinated compounds such as perfluoropolyethers. In some instances an optional release liner may be provided over the thermally transferable composition to protect it during handling, etc.

Thermal transfer articles of the invention are typically wound into roll form for shipping and handling and are sufficiently flexible to be wound around a 2.5 centimeter (1 inch) diameter core at room temperature without cracking or breaking. In many instances, articles of the invention will be used to apply graphics to substantially planar surfaces, but if appropriate application equipment is used they can also be used to apply graphics to non-planar substrates.

Suitable carrier film materials for thermal transfer articles of the invention provide a means for handling the thermal transfer article and are preferably sufficiently heat resistant to remain dimensionally stable (i.e., substantially without shrinking, curling, or stretching) when heated to a sufficiently high temperature to achieve adherence of the adherence layer to the desired substrate. Also, the carrier film preferably provides desired adhesion to the thermally transferable composition during shipping and handling as well as desired release properties from the thermally transferable composition after contact to the substrate and heating.

Finally, the carrier and other components of the article preferably exhibit sufficient thermal conductivity such that heat applied in an imagewise fashion will heat a suitable region of the color layer in order to transfer a graphic pattern of desired resolution. Suitable carriers may be smooth or rough, transparent or opaque, and continuous (or sheet-like). They are preferably essentially non-porous. By "non-porous" it is meant that ink, paints and other liquid coloring media or anti-stick compositions will not readily flow through the carrier (e.g., less than 0.05 milliliter per second at 7 torr applied vacuum, preferably less than 0.02 milliliter per second at 7 torr applied vacuum).

Illustrative examples of materials that are suitable for use as a carrier include polyesters, especially polyethylene terepthalate (PET) commercially available from E.I DuPont Demours company under the trade designation "Mylar", polyethylene naphthalate, polysulfones, polystyrenes, polycarbonates, polyimides, polyamides, cellulose esters, such as cellulose acetate and cellulose butyrate, polyvinyl chlorides and derivatives, aluminum foil, coated papers, and the like. The carrier generally has a thickness of 1 to 500 micrometers, preferably 2 to 100 micrometers, more preferably 3 to 10 micrometers. Particularly preferred carriers are white-filled or transparent PET or opaque paper. The carrier film should be able to withstand the temperature encountered during application. For instance, Mylar polyester films are useful for application temperatures under 200° C. with other polyester films being preferred for use at higher temperatures.

The thermally transferable compositions of the invention may be coated onto the carrier film by many standard web coating techniques, including imprint gravure, single or double slot extrusion coating, and the like. Suitable preparation techniques will depend in part on the nature of thermal transfer article that is desired.

Methods

The invention includes methods for forming a photocured thermally transferred image. The methods include providing a photocurable composition containing a multifunctional monomer that is substantially non-liquid at room temperature and a thermoplastic binder; heating the photocurable composition; transferring the photocurable composition to a substrate; and crosslinking the photocurable composition by exposure to actinic radiation. In some instances, warming the substrate immediately before photocuring can enhance the cure level and hence the durability of the cured graphic. This is especially useful when the substrate upon which the image has been formed has significant thermal conductivity.

Graphic articles of the invention may be applied to many structures. The structures may be flat or have compound, contoured three-dimensional surfaces. For application to these latter complex surfaces, the graphic article needs to be sufficiently flexible to conform thereto without delaminating or lifting off. The actual requisite flexibility will depend in large part on the nature of the structure surface.

EXAMPLES

The invention will be further explained by the following non-limiting illustrative examples. Unless otherwise indicated, all amounts are expressed in parts by weight.

Example 1

Synthesis of Multifunctional Monomer A 500 grams of 20% toluene solution of 4,4'-methylenebis (cyclohexylamine) (Aldrich Chemical Co) was placed in a 2 liter flask and 130 grams of glycidylmethacrylate (Aldrich Chemical Co.) dissolved in 130 grams of toluene was added. The mixture was stirred with heating at 80–90° C. for 72 hrs. 50 grams of methylisobutylketone (MIBK) was added to the mixture, which was then allowed to cool to about 50° C. 130 grams of isocyanatoethylmethacrylate in 200 grams of MIBK was added over a 5-minute period using a dropping funnel. The mixture warmed slightly during the addition. The dropping funnel was rinsed with 50 grams of additional MIBK that was added to the mixture. After the addition was completed, the mixture was allowed to cool to room temperature. The resulting monomer solution was 30% solids. Methyl ethyl ketone (MEK) was added to dilute the solution to 20% solids.

Example 2

Synthesis of Multifunctional Monomer B

Example 1 was modified by using approximately half the molar amount of isocyanatoethylmethacrylate. 200 grams of 20% 4,4'-methlylene bis(cyclohexylamine) in toluene was reacted with 52 grams of glycidylmethacrylate dissolved in 52 grams of toluene under the same conditions as Example 1. The reaction mixture was then cooled to 60° C. 20 grams of MIBK was added to the mixture followed by 25 grams of isocyanatoethylmethacrylate dissolved in 60 grams of MIBK. After cooling to room temperature, 60 grams of MEK was added. The resulting monomer solution was 25% solids. MEK was added to dilute the mixture to 20% solids.

Example 3

Synthesis of Multifunctional Monomer C 13 grams of glycidylmethacrylate were reacted with 10 grams of 4,4'-methlylenebis(cyclohexylamine) in 50 grams of MIBK by heating the reaction for 24 hours at approximately 70° C. This mixture was diluted with 19 grams of toluene and then 4.6 grams of triethylamine was added. The mixture was cooled in an ice bath, and then a solution of 4 grams of acryloylchloride dissolved in 16 grams of toluene was added with rapid stirring over a period of two to three minutes. The mixture was allowed to stand at room temperature for 15 hours and then 100 cc of water was added and the mixture was stirred until all solids had dissolved. Stirring was discontinued and the aqueous and organic layers were allowed to separate. The organic layer was dried over anhydrous potassium carbonate that was subsequently removed by filtration. Evaporation of a portion of the solution showed it to be approximately 25% solids. MEK was added to obtain a 20% solids solution.

Example 4

Synthesis of Multifunctional Monomer D

Example 3 was repeated substituting 4.6 grams of methacryloylchloride dissolved in 15.4 grams of toluene for the acryloylchloride solution. The resulting monomer solution was approximately 25% solids, which was further diluted with MEK to 20% solids.

Example 5

Synthesis of Multifunctional Monomer E

Example 3 was repeated with the acid chloride reactants being 1.0 gram of methacryloylchloride dissolved in 4 grams of toluene followed by 3.0 grams of acryloylchloride dissolved in 12 grams of toluene.

The resulting monomer solution was shown to be approximately 25% solids by evaporation. Additional MEK was added to reduce the solids to 20%.

Example 6

Synthesis of Compatible Adhesion Promoter

The following example describes the synthesis of an additive that can promote adhesion for certain substrates. It also can enhance image sharpness. It was designed to be compatible with the solvents used for the coatings. 90 grams of water-free polyethyleneimine (Aldrich Chemical Co) were dissolved in 144 grams of methanol and then 54 grams of octadecylacrylate (Aldrich Chemical Co) was added dissolved in 90 grams of toluene. The mixture was stirred for one hour at gentle reflux. An additional 90 grams of toluene was added and stirring was continued for one additional hour. 120 grams of additional toluene was added and the temperature was slowly raised and the solvent distilled off until approximately 250 cc of liquid had been collected. The mixture was allowed to cool to 70 to 75° C., at which point 150 grams of MEK and 150 grams of MIBK were added to the mixture. The mixture was cooled to room temperature. This solution was approximately 20% solids.

Example 7

Coating Solution and Ribbon Preparation

The following example is the preparation of a typical coating solution and thermal mass transfer ribbon coating. 64.7 grams of the 20% solids solution from Example 1 was mixed with 19.5 grams of a 20% solution of a thermoplastic polymer binder, VAGH (Union Carbide) in MEK. To this was added 4 grams of a 20% solution in MEK of a photoinitiator commercially available from Ciba under the trade designation "Irgacure 1850" and an additional 4 grams of MEK solvent. Finally, 11.6 grams of a Cyan pigment dispersion was added. The mixture contained 20% solids. This solution was coated using a #10 Meyer Rodonto a 4.5 micron polyester film with BC 25 slip agent backcoating commercially available from Toray Industries, America of New York, N.Y. under the trade designation "F53". The coated film was dried in a forced air oven at 90° C.

Examples 8–19

Formulation of Additional Coating Solutions

Similar coating solutions were prepared as described in Table I:

TABLE I

| Example # | Monomer (20% solution) | Binder (20% solution in MEK) | Pigment Dispersion (20% solids)[1] | Photo-initiator Irgacure 1850 - 20% in MEK | Additive - Example 6 |
|---|---|---|---|---|---|
| Example 8 | A (56.3 grams) | Joncryl 587 Acrylated[2] (19.5 grams) | Cyan (11.6 grams) | 4 grams | 8.4 grams |
| Example 9 | B (54.8 grams) | VAGH (16 grams) | Cyan (15.5 grams) | 4 grams | 8.2 grams |
| Example 10 | C (53.6 grams) | VAGH (21.6 grams) | Black (11.1 grams) | 4 grams | 8.1 grams |
| Example 11 | C (66.5 grams) | VAGH (16.8 grams) | Black (11.1 grams) | 4 grams | |
| Example 12 | D (80.7 grams) | VAGH (2.6 grams) | Black (11.1 grams) | 4 grams | |
| Example 13 | E (80.7 grams) | VAGH (2.6 grams) | Black (11.1 grams) | 4 grams | |
| Example 14 | A (39.7 grams) + SR368[3] (16.65) | VAGH (19.55 grams) | Cyan (11.63 grams) | 4 grams | 8.4 grams |

TABLE I-continued

| Example # | Monomer (20% solution) | Binder (20% solution in MEK) | Pigment Dispersion (20% solids)[1] | Photo-initiator Irgacure 1850 - 20% in MEK | Additive - Example 6 |
|---|---|---|---|---|---|
| Example 15 | A (56.3 grams) | VAGH (19.5) | Cyan (11.6) | 4 grams | 8.4 grams |
| Example 16 | A (51.7 grams) | VAGH (10.5 grams) | Yellow (24 grams) | 4 grams | 7.7 grams |
| Example 17 | A (51.7 grams) | VAGH (10.5 grams) | Magenta (20 grams) | 4 grams | 7.7 grams |
| Example 18 | A (55.4 grams) | VAGH (6.3 grams) | Black (20 grams) | 4 grams | 8.3 grams |
| Example 19 | A (64.7 grams) | VAGH (27.7) | MEK-ST[4] (5.0 g - 30% solids) | 4 grams | |

Notes on Table 1:

1. Dispersions were prepared with commonly available pigments. Binders, solvents (MEK, toluene, and MIBK), and other additives were selected to maintain stable pigment dispersion and uniform coating characteristics. Preparation of the dispersions followed the methods outlined in Union Carbide bulletin "Ucar Solution Vinyl Resins for Coatings", UC-669B, P8-8429 (October 1998).
2. The binder in Example 8 contained a hydroxy-functional resin commercially available from SC Johnson Co. under the trade designation "Joncryl 587", which was reacted with acryloyl chloride in the presence of tri-ethylamine as an acid acceptor. This binder can participate in the photo-crosslinking.
3. Tris(2-hydroxyethyl) isocyanurate triacrylate commercially available from Sartomer Co. of Exton, Pa. under the trade designation "SR368".
4. Dispersion of colloidal silica particles in methylethylketone commercially available from Nissan Chemical America, Inc. of Houston, Tex. under the trade designation "MEK-ST".

Example 20

The following example shows printing the thermally transferable composition on a variety of substrates. The ribbon from example #15 was used to print on a variety of receptor films using a thermal transfer printer commercially available from Zebra Technologies Corp. of Vernon Hills, Ill. under the trade designation "Zebra 170 XiII Thermal Transfer Printer". After printing, the images were cured using a UV processor commercially available from RPC Industries of Plainfield, Ill. under the trade designation "QC120233AN", with two 30.5 cm mercury vapor lamps (07-0224) under nitrogen atmosphere. The samples were run through the processor at about 15 meters per minute with the sample about 7.5 cm from the lamps such that the samples received a dosage of 560 to 650 mJ/cm$^2$. The results are shown below in Table II.

TABLE II

| Substrate | Print Head Setting[1] | Image Quality[2] | Adhesion[3] | Solvent Resistance[4] |
|---|---|---|---|---|
| Scotchlite 4770 Sheeting[5] | 24 | 4 | 5B (100%) | 4 (MEK, IPA[6], Gasoline) |
| Scotchlite 9500 Sheeting[7] | 22 | 3 | 0B (poor) | 4 (IPA)<br>4 (Gasoline)<br>2 (MEK) |
| Scotchlite Reflective Film | 26 | 4 | 0B (poor) | 4 (IPA)<br>4 (Gasoline) |

TABLE II-continued

| Substrate | Print Head Setting[1] | Image Quality[2] | Adhesion[3] | Solvent Resistance[4] |
|---|---|---|---|---|
| Series 280i[8] | | | | 2 (MEK) |
| Scotchlite 3290 Engineer Grade Sheeting[9] | 24[10] | 3 | 0B | 4 (IPA)<br>4 (Gasoline)<br>2 (MEK) |
| Scotchlite 3870 High Intensity Sheeting[11] | 24 | 4 | 5B (100%) | 4 (IPA)<br>4 (Gasoline)<br>3 (MEK) |
| Controltac 180c Film[12] | 26 | 4 | 5B (100%) | 4 (MEK)<br>4 (IPA)<br>4 (Gasoline) |
| Scotchlite 3750 Sheeting[13] | 24 | 4 | 5B (100%) | 4 (IPA)<br>2 (MEK)<br>4 (Gasoline) |
| Radiant Color Film CM 590[14] | 20 | 4 | 0B (poor) | 4 (MEK)<br>4 (IPA)<br>4 (Gasoline) |

Notes:

1. Print Head Setting refers to the temperature settings for the thermal transfer printheads of the Zebra 170 XiII printer. Higher numbers are higher temperatures.
2. Image Quality ratings—Test images include text, solid fill areas, bar codes printed both vertically and horizontally.
   4=Excellent Image—Sharp edges on text and bar codes, good solid fill.
   3=Good Image—Sharp edges on text and vertical barcodes, good solid fill; some roughness on horizontal bar codes.
   2=Rough trailing edges on text and bar codes.
   1=Poor printing—severe fill-in on smaller text and bar codes.
3. Adhesion was evaluated by ASTM D3359 95b Tape Adhesion Test (method B)
   5B=100% adhesion
   4B=95+% adhesion
   3B=85 to 95% adhesion
   2B=65 to 85% adhesion
   1B=35 to 65% adhesion
   0B=less than 35% adhesion
4. Solvent Resistance was evaluated by ASTM D-5402-93. Solvent rubs were performed on the image surface using a cotton tipped applicator soaked in the test solvent. The cotton tipped applicators are commercially available from Hardwood Products Company of Guilford, Me. under the trade designation "Puritan Cotton Tipped Applicators".
   4=No effect on image surface and no transfer of color to cotton tipped applicator.

3=No visible effect on image surface, but some color transferred to the applicator.

2=Pitting or marring of the image surface.

1=Severe pitting or marring of the image surface, substrate may be exposed.

5. Reflective sheeting commercially available from Minnesota Mining and Manufacturing Company ("3M") of St. Paul, Minn. under the trade designation "3M Scotchlite Reflective License Plate Sheeting Series 4770".
6. IPA=Isopropyl alcohol.
7. Reflective sheeting commercially available from 3M under the trade designation "3M 9500 Scotchlite Reflective Sheeting".
8. Reflective sheeting commercially available from 3M under the trade designation "3M Scotchlite Reflective Film Series 280i".
9. Reflective sheeting commercially available from 3M under the trade designation "3M Scotchlite Engineer Grade Reflective Sheeting Series 3290".
10. This sample demonstrated some sticking of the thermal transfer composition to the printer ribbon.
11. Reflective sheeting commercially available from 3M under the trade designation "3M Scotchlite High Intensity Grade Reflective Sheeting Series 3870".
12. Graphic film commercially available from 3M under the trade designation "3M Controltac Plus Graphic Film Series 180".
13. Reflective sheeting commercially available from 3M under the trade designation "3M Scotchlite Reflective License Plate Sheeting Series 3750".
14. Film commercially available from 3M under the trade designation "3M Radiant Color Film CM 590".

Example 21

The next examples show the results of using several ribbon formulations to print on vinyl films using an edge printer commercially available from Gerber Scientific Products of Manchester, Conn. under the trade designation "Gerber Edge Printer Model FGP300". Several of the samples from Table I were used to print on a film commercially available from 3M under the trade designation "3M Scotchcal Film Series 220" using the Gerber printer. After printing, the images were cured using the model QC120233AN UV processor and under the conditions described in Example 20. The results are listed in Table III.

TABLE III

| Ribbon | Image Quality | Solvent Resistance | Adhesion |
|---|---|---|---|
| Example 15 | 4 | 4 (IPA)<br>2 (MEK)<br>4 (Gasoline) | 5B (100%) |
| Example 16 | 4 | 4 (IPA)<br>2 (MEK)<br>4 (Gasoline) | 5B (100%) |
| Example 17 | 4 | 4 (IPA)<br>2 (MEK)<br>4 (Gasoline) | 5B (100%) |
| Example 18 | 4 | 4 (IPA)<br>2 (MEK)<br>4 (Gasoline) | 5B (100%) |

Comparative Example 21a

An image was printed on Scotchcal 220 film using the Gerber edge printer and a ribbon available from Gerber Scientific Products under the trade designation "GPC-707". This ribbon is not photocurable.

| | |
|---|---|
| Image Quality | = 4 |
| Solvent Resistance | = 1 (MEK) - Substrate exposed after only 1 rub.<br>2 (Gasoline) - After 100 double rubs<br>4 (IPA) - After 100 double rubs |

Examples 21 and 21a were subjected to rubbing with a #2 pencil eraser. The photocured samples (Examples 21) showed minimal surface marring after 100 rubs while the sample 21a was relatively easily removed after 25 rubs.

Example 22

An image using the Gerber Edge Printer was printed on Scotchcal 220 film using the Gerber Ribbon GPC-707. This was overprinted with the ribbon from Example 19 (a thermal mass transfer, photocurable clear-coat), and the overcoated image was photocured using the model QC120223AN UV processor and under the conditions described in Example 20. The overcoated image had improved solvent resistance 2(MEK), after 100 solvent double rubs, 4 (IPA) 4(Gasoline) and improved rub resistance, with no marring of the image after 100 double rubs with a #2 pencil eraser.

Example 23

Table IV shows additional printing results for ribbons from Table I. The printer used was a Zebra 170 XiII Thermal Transfer Printer.

TABLE IV

| Ribbon | Sheeting Substrate | Print Quality | Adhesion | Solvent Resistance |
|---|---|---|---|---|
| Example 7 | Scotchlite 4770 | 3 | 5B (100%) | 4 (MEK)<br>4 (IPA)<br>4 (Gasoline) |
| Example 8 | Scotchlite 3870 | 3 | 5B (100%) | 3 (MEK)<br>4 (IPA)<br>4 (Gasoline) |
| Example 9 | Scotchlite 4770 | 4 | 5B (100%) | 2 (MEK)<br>4 (IPA)<br>4 (Gasoline) |
| Example 10 | Scotchlite 4770 | 4 | 5B (100%) | 4 (MEK)<br>4 (IPA)<br>4 (Gasoline) |
| Example 11 | Scotchlite 4770 | 4 | 5B (100%) | 4 (MEK)<br>4 (IPA)<br>4 (Gasoline) |
| Example 12 | Scotchlite 4770 | 3 | 5B (100%) | 4 (MEK)<br>4 (IPA)<br>4 (Gasoline) |
| Example 13 | Scotchlite 4770 | 4 | 5B (100%) | 4 (MEK)<br>4 (IPA)<br>4 (Gasoline) |
| Example 14 | Scotchlite 4770 | 3 | 5B (100%) | 4 (MEK)<br>4 (IPA)<br>4 (Gasoline) |

Example 24

The following Example shows the use of a formulation in thermal transfer by a hot stamp process. This example also shows that when curing is conducted on a heat conducting substrate, it is useful to preheat the sample to get full cure. A coating solution was prepared by mixing 80.75 grams of the monomer solution A, 2.6 grams of 20% VAGH in toluene/MEK (3:1) and 11.1 grams of a black pigment dispersion at 20% solids. This material was machine coated using a #10 Meyer Rod onto 18 micrometer polyester. The coating did not block in roll form. This ribbon was used to hot stamp print on embossed license plate blanks with Scotchlite 4770 Reflective sheeting on aluminum. The imaged plates were photocured using the model QC120233AN UV processor and under the conditions described in Example 20. In order to achieve full cure, it was necessary to pre-warm the imaged plated before curing by warming to 90° C. Without the pre-warming, maximum solvent resistance was not achieved.

Results:

| | |
|---|---|
| Cure without pre-warming: | |
| Adhesion= | 4B (95+%) |
| Solvent Resistance= | IPA = 4 |
| | MEK = 1 |
| Cure with Pre-warming | |
| Adhesion= | 5B (100%) |
| Solvent Resistance= | IPA = 4 |
| | MEK = 4 |

The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

We claim:

1. A method of forming a photocured thermally transferred image, the method comprising:

providing a photocurable composition containing a multifunctional monomer that is substantially non-liquid at room temperature, wherein the multifunctional monomer comprises a dicyclohexane compound of the general formula:

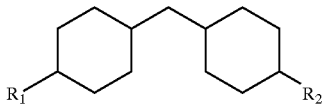

wherein $R_1$ and $R_2$ comprise functional groups containing a total of at least two acrylate groups and a thermoplastic binder;

heating the photocurable composition;

transferring the photocurable composition to a substrate; and crosslinking the photocurable composition by exposure to actinic radiation.

2. The method of claim 1 wherein the thermoplastic binder is polymeric.

3. The method of claim 1 wherein the multifunctional monomer comprises from 10 to 200 carbon atoms.

4. The method of claim 1 wherein the multifunctional monomer comprises a dicyclohexane compound of the general formula:

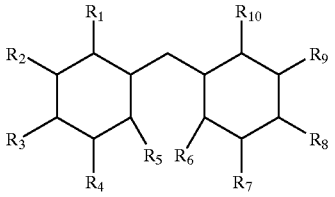

wherein at least 2 (number) of $R_1$ to $R_{10}$ comprise functional groups containing acrylate groups.

5. The method of claim 1 wherein the multifunctional monomer comprises from 2 to 4 functional groups.

6. The method of claim 1 wherein the multifunctional monomer comprises from 2 to 10 functional groups.

7. The method of claim 1 wherein the composition comprises 50 percent or more by weight multifunctional monomer based upon total weight of multifunctional monomer and binder.

8. The method of claim 1 wherein the composition comprises from 60 to 80 percent by weight multifunctional monomer and from 20 to 40 percent by weight thermoplastic polymeric binder based upon total weight of multifunctional monomer and binder.

9. The method of claim 1 wherein the polymeric binder comprises vinyl or acrylate resin.

10. The method of claim 1 further comprising a colorant.

11. The method of claim 1 wherein the colorant is a pigment.

12. The method of claim 1 wherein the composition is substantially clear after being thermally transferred and cured by actinic radiation.

13. The method of claim 1, wherein the multifunctional monomer comprises from 15 to 60 carbon atoms.

14. The method of claim 1, further comprising heating the substrate and photocurable composition before curing the photocurable composition.

15. A printed article containing an image, the image comprising a thermally transferred image according to the method of claim 1.

16. The method of claim 1 wherein the step of crosslinking the photocurable composition is after the step of apply the composition to the substrate.

* * * * *